US010662663B2

(12) United States Patent
McFarland

(10) Patent No.: US 10,662,663 B2
(45) Date of Patent: May 26, 2020

(54) WAVE GENERATOR WITH WAVE DAMPING

(71) Applicant: American Wave Machines, inc., Solana Beach, CA (US)

(72) Inventor: Bruce McFarland, Solana Beach, CA (US)

(73) Assignee: American Waves Machines, Inc., Solana Beach, CA (US)

( * ) Notice: Subject to any disclaimer, the term of this patent is extended or adjusted under 35 U.S.C. 154(b) by 0 days.

(21) Appl. No.: 15/841,166

(22) Filed: Dec. 13, 2017

(65) Prior Publication Data

US 2018/0106058 A1 Apr. 19, 2018

Related U.S. Application Data

(63) Continuation-in-part of application No. 15/277,521, filed on Sep. 27, 2016.

(51) Int. Cl.

| | |
|---|---|
| ***E04H 4/00*** | (2006.01) |
| ***A63B 69/00*** | (2006.01) |
| ***E04H 4/12*** | (2006.01) |

(52) U.S. Cl.

CPC ..... *E04H 4/0006* (2013.01); *A63B 69/0093* (2013.01); *E04H 4/1245* (2013.01)

(58) Field of Classification Search

CPC ..... E04H 4/006; E04H 4/1218–1227; A63B 69/125; A63B 69/0093

See application file for complete search history.

(56) References Cited

U.S. PATENT DOCUMENTS

| | | | | |
|---|---|---|---|---|
| 586,983 | A * | 7/1897 | Wharton | E04H 4/0006 4/491 |
| 4,197,815 | A * | 4/1980 | Brazelton | A01K 13/001 119/673 |
| 4,276,661 | A * | 7/1981 | Baker | E04H 4/0006 4/491 |
| 4,539,719 | A * | 9/1985 | Schuster | E04H 4/0006 4/491 |
| 4,997,558 | A * | 3/1991 | Baker | E04H 4/1209 210/143 |

(Continued)

OTHER PUBLICATIONS

International Search Report and Written Opinion dated Feb. 16, 2017 in PCT/US2017/014065 (12 pages).

*Primary Examiner* — David P Angwin
*Assistant Examiner* — Nicholas A Ros
(74) *Attorney, Agent, or Firm* — Manuel de la Cerra

(57) ABSTRACT

A wave-generating apparatus is disclosed. The apparatus includes a wave pool with a bottom, wherein the bottom is upwardly-inclined along a length of the wave pool and defines a deep edge and a beach edge. A wave generator is placed adjacent to the deep edge. An open wave-damping trough is placed adjacent to the beach edge and is adapted to retain water. The apparatus is constructed such that when the wave generator is not actuated, the pool retains water defining a static water level, and a portion of the beach edge is above the static water level. When the wave generator is actuated, it creates a wave that propagates across the wave pool from the deep edge to the beach edge, and the wave energy is dampened when the wave encounters the water retained in the trough.

14 Claims, 15 Drawing Sheets

(56) References Cited

U.S. PATENT DOCUMENTS

| | | | | |
|---|---|---|---|---|
| 6,460,201 | B1 * | 10/2002 | Lochtefeld | E04H 4/0006 4/491 |
| 6,928,670 | B2 * | 8/2005 | Lochtefeld | E04H 4/0006 4/491 |
| 7,296,308 | B2 * | 11/2007 | Turner | A63B 69/125 239/390 |
| 8,561,221 | B2 | 10/2013 | Lochtefeld et al. | |
| 8,602,684 | B2 * | 12/2013 | Aufleger | A63G 31/007 4/491 |
| 2010/0124460 | A1 * | 5/2010 | Fricano | A63B 69/0093 405/79 |
| 2010/0125943 | A1 * | 5/2010 | Lochtefeld | E04H 4/0006 4/491 |
| 2013/0074154 | A1 | 3/2013 | Barrett | |
| 2013/0074254 | A1 * | 3/2013 | Payne | E04H 4/0006 4/491 |
| 2014/0115769 | A1 * | 5/2014 | Murphy | E04H 4/0006 4/491 |
| 2014/0189948 | A1 | 7/2014 | Lochtefeld et al. | |
| 2014/0250579 | A1 * | 9/2014 | Slater | E04H 4/0006 4/491 |

* cited by examiner 20
16
15
30
28
26
25B
25A
34
33
32

Section A-A
31F
31E
31D
31B
31G
31C
31A 27
29
40
35
42

Section B-B

Section C-C

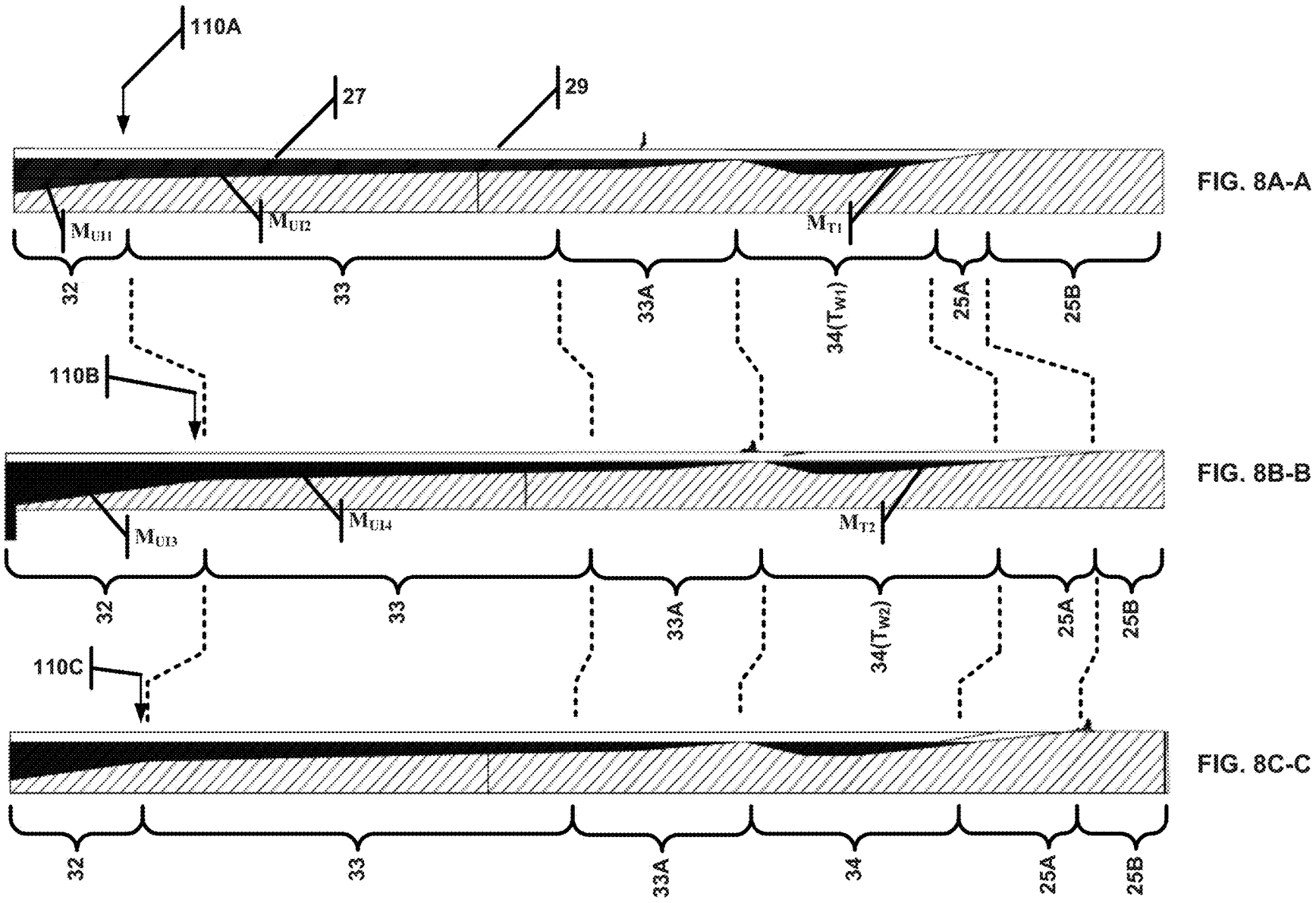
FIG. 8A-A
FIG. 8B-B
FIG. 8C-C
110A
110B
110C
27
29
32
33
33A
34(Tw1)
34(Tw2)
34
25A
25B
MU1
MU2
MU3
MU4
MT1
MT2

WAVE GENERATOR WITH WAVE DAMPING

RELATED APPLICATIONS

This application claims priority as a continuation-in-part of U.S. patent application Ser. No. 15/277,521, filed on Sep. 27, 2016, titled "WAVE GENERATOR WITH WAVE DAMPING", the disclosure of which is also herein incorporated by reference in its entirety.

This application is related to U.S. patent application Ser. No. 14/808,076, filed on Jul. 24, 2015, titled "SEQUENCED CHAMBER WAVE GENERATOR CONTROLLER AND METHOD", the disclosure of which is herein incorporated by reference in its entirety. This application is also related to U.S. patent application Ser. No. 15/246,233, filed on Aug. 24, 2016, titled "WAVE GENERATING APPARATUS AND METHOD," the disclosure of which is also herein incorporated by reference in its entirety.

TECHNICAL FIELD

The present invention relates generally to a wave-forming apparatus and is partially concerned with water rides of the type provided in water-based amusement parks, particularly a wave-forming apparatus and method for forming surfable waves, or a water toy.

BACKGROUND

Wave generators are often used for recreational purposes. Wave generators create one or more waves in a pool or the like, and people typically either play in the waves or use the waves for aquatic sports such as board sports. Aquatic board sports, such as surfing and bodyboarding, require that the waves be rideable. Enthusiasts in these types of sports often use wave generators for competition, practice or entertainment.

Existing wave generators can use wave-generating chambers or submerged or partially-submerged moving objects to produce a wave that travels in a direction where the peak of the wave is substantially parallel to the chambers and to the beach as it travels from the chambers toward the beach. The wave is produced when the wave chambers (either one chamber or multiple chambers) are all activated simultaneously, resulting in the water being pushed away from the wave-generating chambers and then traveling at an angle away from the chambers. Such a system is disclosed in U.S. Pat. No. 9,103,133 and patent application Ser. No. 15/246,233, filed on Aug. 24, 2016; the contents of both are incorporated herein by reference.

To provide for a more authentic experience, sand may be placed on the beach edge of the wave pool—i.e., the edge that is opposite to the wave generators. When the wave breaks, however, the wave turbulence can cause the sand to dislodge and travel away from the intended beach edge. Not only does this affect the authenticity of the experience, the sand can also travel into the pumps and affect other mechanisms of the wave-generating apparatus, causing damage or premature failure.

Even without sand, unbroken waves and whitewater that reach the shore elevation of a surf pool typically run up a slope and back into the pool. This creates unwanted backwash and reflections, resulting in a reduction of wave quality and the buildup of energy in the pool.

What is needed, therefore, is an apparatus that overcomes the shortcomings of the prior art, including minimizing backwash and the unwanted movement of sand.

SUMMARY

To address the shortcomings in the prior art and to improve artificial wave generation, a wave-generating apparatus with a wave-damping trough is disclosed and claimed herein. The apparatus includes a wave pool with a bottom, wherein the bottom is upwardly-inclined along a length of the wave pool and defines a deep edge and a beach edge. A shore is adjacent to the beach edge. A wave generator is placed adjacent to the deep edge. An open wave-damping trough is placed adjacent to shore and adapted to retain water. The apparatus is constructed such that when the wave generator is not actuated, the pool retains water defining a static water level, and a portion of the beach edge is above the static water level. When the wave generator is actuated, it creates a wave that propagates across the wave pool from the deep edge to the beach edge, and the wave energy is dampened when the wave encounters the water retained in the trough. The trough water creates a hydraulic jump that abruptly changes the flowing water velocity, absorbing the wave propagation energy.

In one embodiment, the pool bottom may have different angles of inclination at different portions of the pool. The angle of inclination of the pool bottom may be steepest near the wave generator. Further, the wave generator may actually comprise a plurality of wave generators. The beach edge may be semi-circular.

The trough may also have a pump that creates a current in the trough, wherein the direction of the current may be substantially orthogonal to the direction of the wave propagation.

To optimize energy dissipation, the trough may have a width that is at least twice the maximum wave height, optimally four times the maximum wave height, and the shore may have a width that is similar to the trough width, optimally at least twice the trough width.

Additional aspects, alternatives and variations as would be apparent to persons of skill in the art are also disclosed herein and are specifically contemplated to be included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

FIG. 8A-A is a first cross-sectional profile taken along line A-A of FIG. 8.

FIG. 8B-B is a second cross-sectional profile taken along line B-B of FIG. 8.

FIG. 8C-C is a third cross-sectional profile taken along line C-C of FIG. 8.

DETAILED DESCRIPTION

Figure 1:
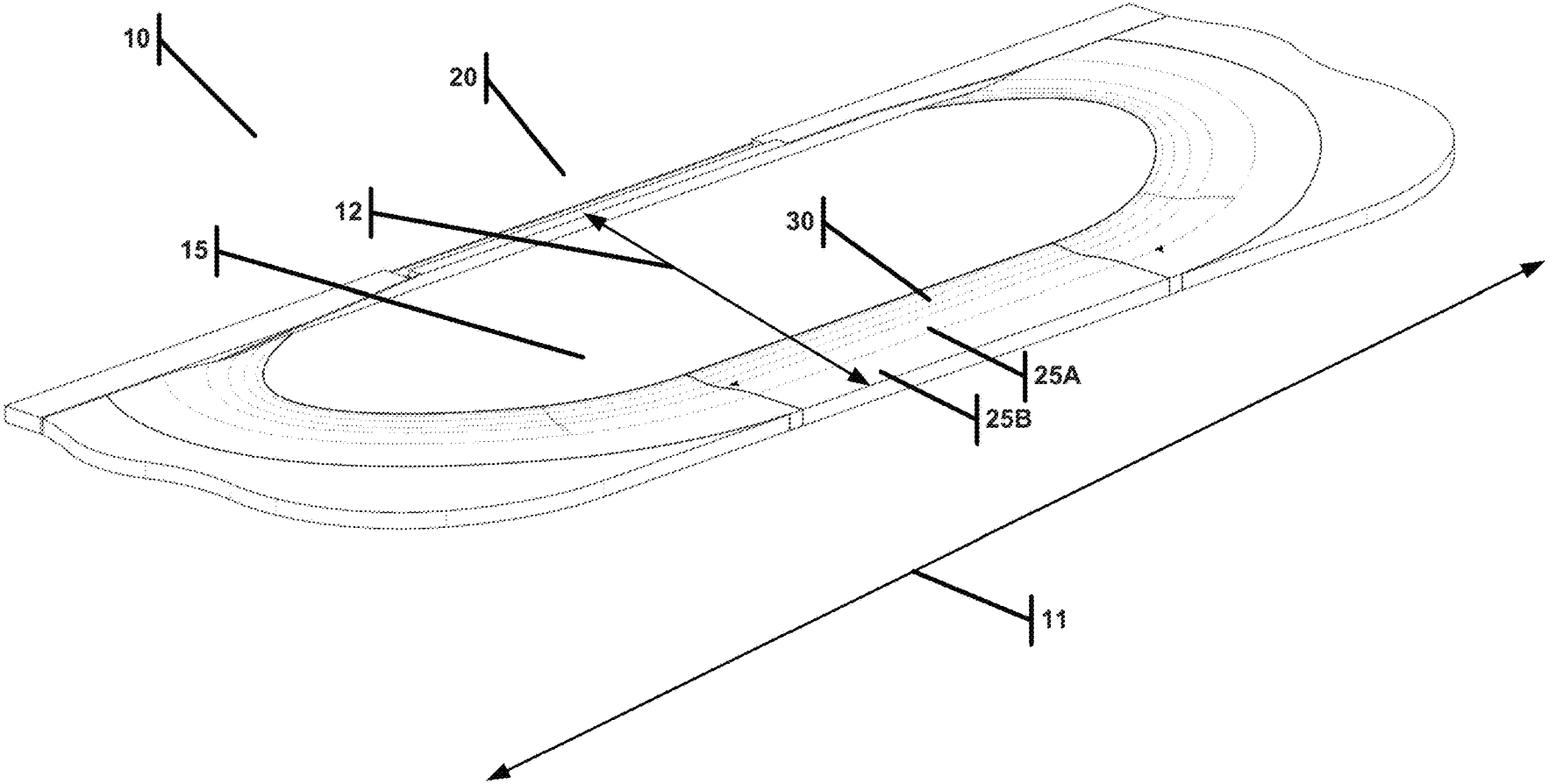
FIG. 1 is an isometric view of a wave-generating apparatus with a novel wave-damping trough.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention, as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all, in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection, unless otherwise noted.

The following list of example features corresponds with FIGS. 1-8C-C and is provided for ease of reference, where like reference numerals designate corresponding features throughout the specification and figures:

10—Wave-generating apparatus

11—Apogee

12—Perigee
15—Wave pool
16—Deep edge
20—Wave generators
25A—Shore
25B Beach edge of pool
26 Shore terminal edge
27—Static water level
28—Portion of shore above static water level
29—Grade level
30 Wave-damping trough
31A—Mound
31B—Mound maximum height point
31C—Plane
31D—Trough bottom
31E Intersection point of trough bottom
32—First portion of upwardly-inclined wave pool bottom
33—Second portion of upwardly-inclined wave pool bottom
33A Third portion of upwardly-inclined wave pool bottom
34—Width of wave-damping trough
35—Pump
36A—Bladder
36B—Piston/ram
36C—Cam
37—Flexible covering
38—Variance in mound height
40—Wave-generating chamber
42—Throat
45—Wave (Curling)
50—Wave (Curling-breaking)
55—Wave whitewater
60—Wave whitewater first dampened by trough
65—Wave whitewater dampened with more of the water in trough
70—Wave whitewater dampened with all of the water in trough
75 Wave whitewater
80 Wave whitewater first dampened by trough
85 Wave whitewater dampened with more of the water in trough
90 Formation of backwash
95 Propagation of backwash dampened by water in trough
100 Minimal backwash propagating out of the trough
105 Movement of whitewater lateral (or somewhat lateral) to the original wave propagation direction
110A, B, C Wave breaking positions
115 Uniform floor bottom region
120 Rideable wave propagation direction
125 Undulating wave-damping trough
130 Direction of wave propagation
135 Movement of whitewater lateral (or somewhat lateral) to the original wave propagation direction
140 Trough width FIGS. 1-5 illustrate a wave-generating apparatus 10 having an oval wave pool 15 with an apogee of 750 feet (line 11) and a perigee of 245 feet (line 12). The wave pool 15 has a bottom (32, 33) with two portions: the first portion 32 has an angle of inclination relative to horizontal that is steeper than the angle of inclination of the second portion 33. The variance in steepness assists in creating the wave. The pool bottom may alternatively have a single angle of inclination or multiple angles of inclination.

The pool bottom (32, 33) defines a deep edge 16 and a beach edge 25B, and adjacent to the deep edge 16 are the wave generators 20. When the wave generator 20 is not actuated, the pool 15 retains water defining a static water level 27, and a portion of the shore edge 28 is above the static water level 27. In the embodiment illustrated in FIGS. 1-5, the portion of the beach edge 28 is at grade level and is two feet above the static water level 27.

Adjacent to the beach edge 25B is a shore 25A, which may have an upwardly-inclined bottom. An open wave-damping trough 30 is disposed adjacent to the shore 25A and retains water, and optionally the trough can drain water or have a water level that can be controlled. FIG. 3C illustrates an enlargement of the trough 30 and the shore 25A. Between the trough 30 and the pool bottom (32, 33) is a mound 31A that has a maximum height point 31B. The trough 30 has a trough bottom 31D that begins at the maximum height point 31B and slopes down and up, forming a bowl in which water can be retained. Drawing a horizontal plane 31C intersecting this maximum point 31B defines one edge of the trough 30, while the other edge is defined by the point where the trough bottom 31D intersects the plane 31C (shown as point 31E). From point 31E to the point where the shore bottom is substantially horizontal defines the shore 25A and the shore terminal edge 26. In the embodiment illustrated in FIGS. 1-5, the depth of the open wave-damping trough 30 is about one foot below the static water level 27, the width of the trough is about 25 feet (as shown by bracket 34), and the width of the shore 25A is approximately 50 feet. The trough 30 can be initially dry, then filled by the wave surge.

Shown in FIG. 3B is one of the wave generators, which includes a pump 35 and a wave-generative chamber 40, that pushes water through the throat 42, causing the water in the pool 15 that is adjacent to the wave generators to rise rapidly, forming a wave that propagates across the wave pool 15 towards the beach edge 25B. The actual operation of the wave generator illustrated in FIG. 3B is detailed in U.S. Pat. No. 9,103,133 and patent application Ser. No. 15/246,233, filed on Aug. 24, 2016, the contents of which are both incorporated herein by reference. When this wave encounters the wave-damping trough 30, the trough 30 provides inertial resistance to the incoming surge, thereby decreasing its momentum/energy. The loss of wave surge energy minimizes the problems of backwash and reflections that result in reduction of wave quality and unwanted sand migration.

While FIGS. 1-5 illustrate a chamber-base wave generator, other wave generators can use the damping trough disclosed herein. For example, one type of wave generator uses a sled submerged in an existing body of water such as a lake. The sled includes a scoop, and as the sled is moved towards the beach or shore of the lake, it creates a wave on the surface. The energy in that wave could cause reflection, diminishing the quality of the waves, and leading to undesirable sand migration.

As an additional feature, the water in the wave-damping trough may be static or may be pumped by pump 31F to create a current of water. The current may be, for example, substantially orthogonal to the direction of the wave propagation. Such a current opens the possibility of using the trough for other recreational activities such as stand up paddle boarding. Optionally, the trough can be separately drained or pumped away or back into the pool 15 by way of pump 31F. Moreover, the level of water in the trough 30 can be controlled through pumping to further optimize its damping ability.

The trough 30 can also contain sand 31G so as to act as a water filter. By pumping water from the wave pool into and then out of the trough 30, the sand bed can act as a particulate filter. This filtration function may be used whether or not the wave-generating apparatus is producing rideable waves. Additionally, the mound 31A may have a controllable height so as to let more water from the wave pool 15 into the trough 30. Controlling the mound 31A height can fine-tune the damping ability of the trough 30, and can also be used to allow more effective filtration. For example, in the embodiments shown in FIGS. 1-5, the mound maximum height point 31B is at the same height as the static water level 27, so in a placid wave pool 15, lowering the mound 31A would allow water from the wave pool 15 to freely flow into the trough 30. Therefore, the mound 31A could be set a height shown in FIG. 3C during wave generation, and when the apparatus is in a non-wave generation mode, the mound 31A could be lowered to allow water to freely flow into the trough 30 and be filtered therein. The adjustability of the mound 31A may be on certain segments of the trough 30 or on the entire length of the trough 30.

Figures 3A, 3B, 3C:
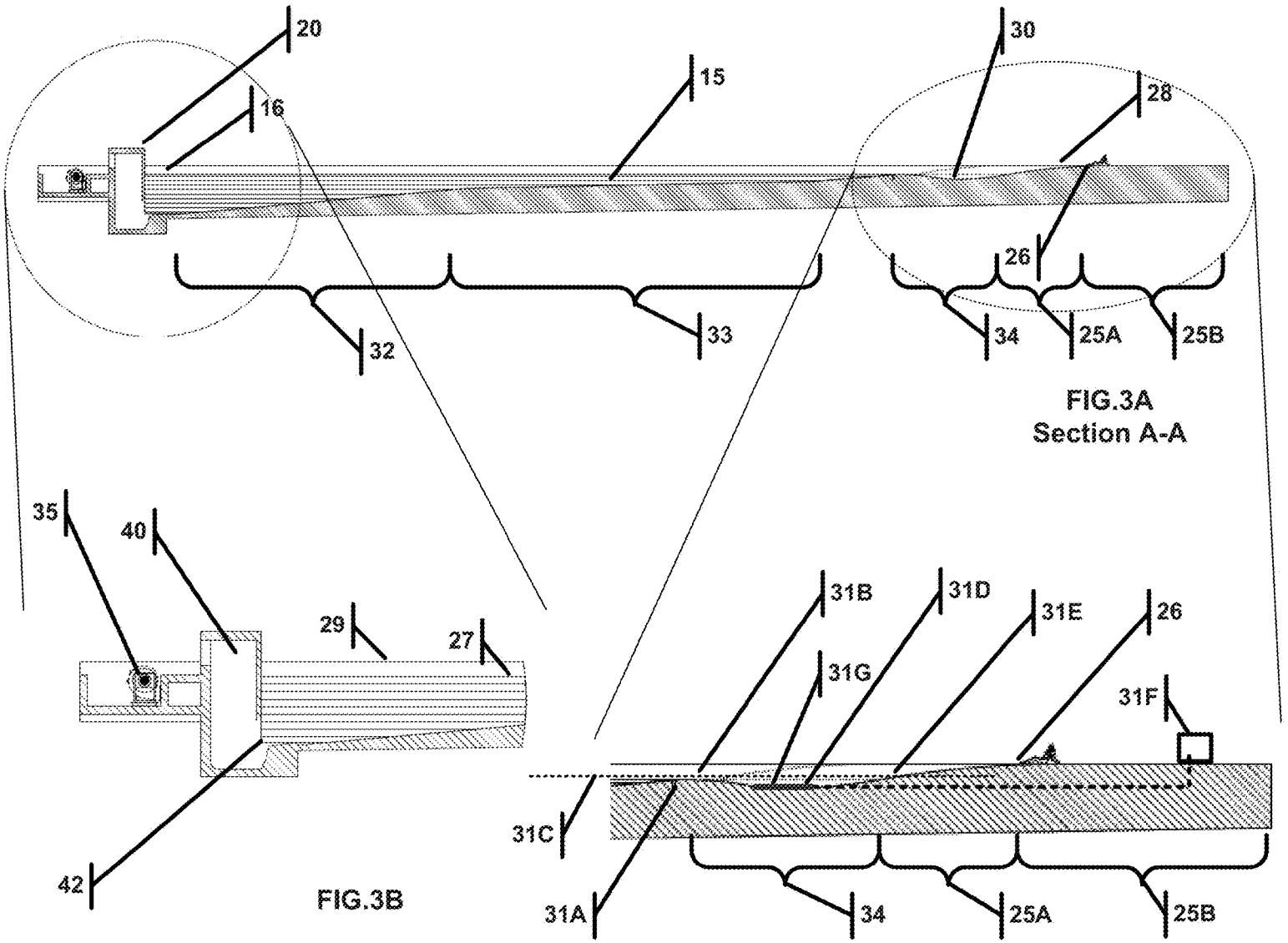
FIG. 3A is the cross-sectional view along line A-A shown in FIG. 2.
FIG. 3B is an enlarged section of the wave generator found in FIG. 3A.
FIG. 3C is an enlarged section of the wave-damping trough and beach edge found in FIG. 3A.
Figure 3D:
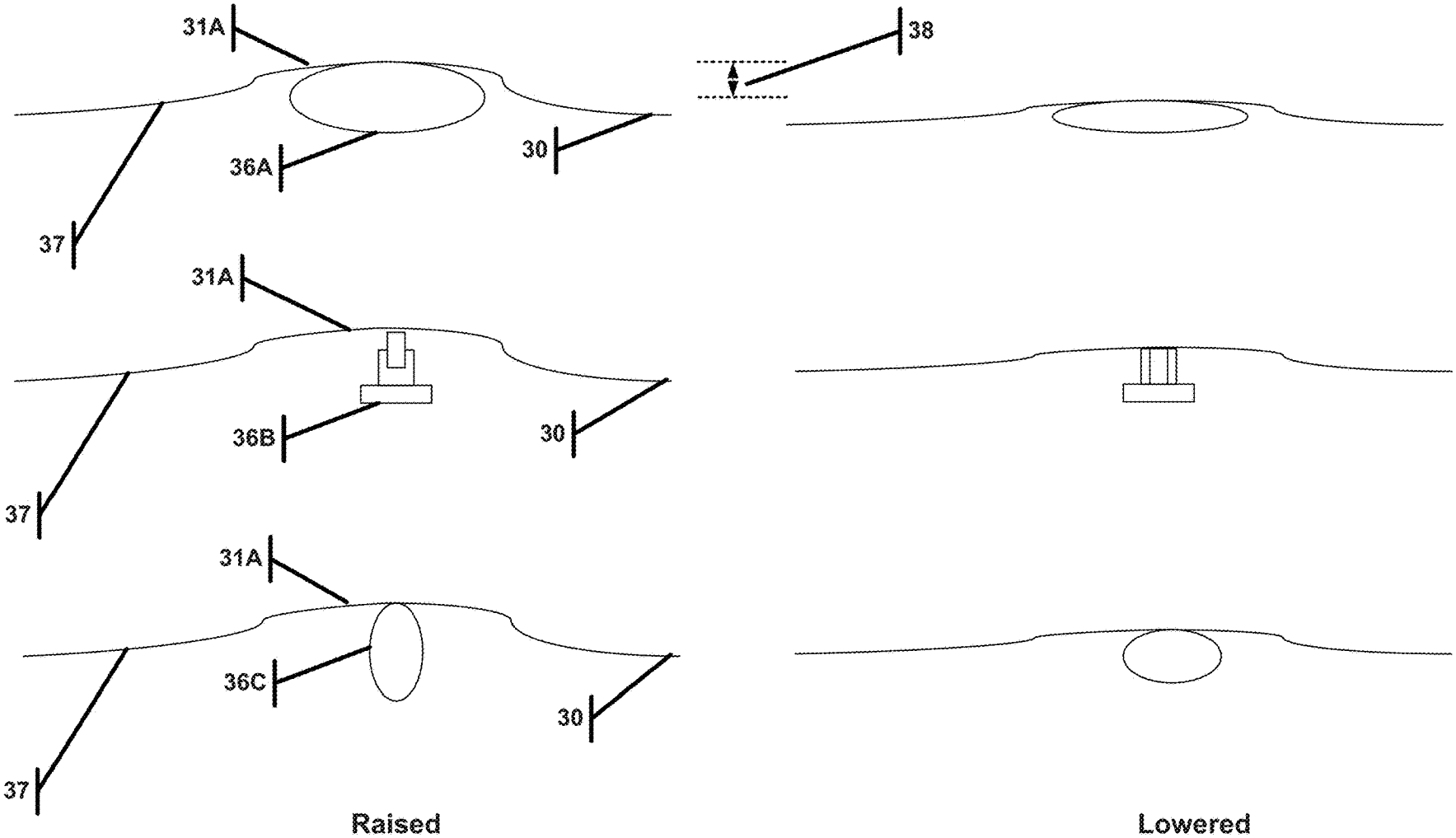
FIG. 3D illustrates a mound elevator.

FIG. 3D shows three different mound elevators: a bladder 36A, a piston or ram 36B and a cam 36C. Any of these mound elevators may be covered with a flexible covering 37, which may be reinforced or unreinforced PVC typical of pond liners or other suitable materials. This flexible covering 37 is the surface which may contact the user and would prevent the user from harm, should the user come into contact with the mound elevator. In the case of the bladder 36A, the mound 31A is lowered by releasing fluid from the bladder 36A, as shown on the right side of FIG. 3D. Arrow 38 shows the amount the mound 31A was lowered. Likewise, the piston/ram 36B is retracted, and the mound 31A lowers. Finally, the cam 36C is rotated, which lowers the mound 31A. It would be apparent that other mechanisms may be used.

Figure 2:
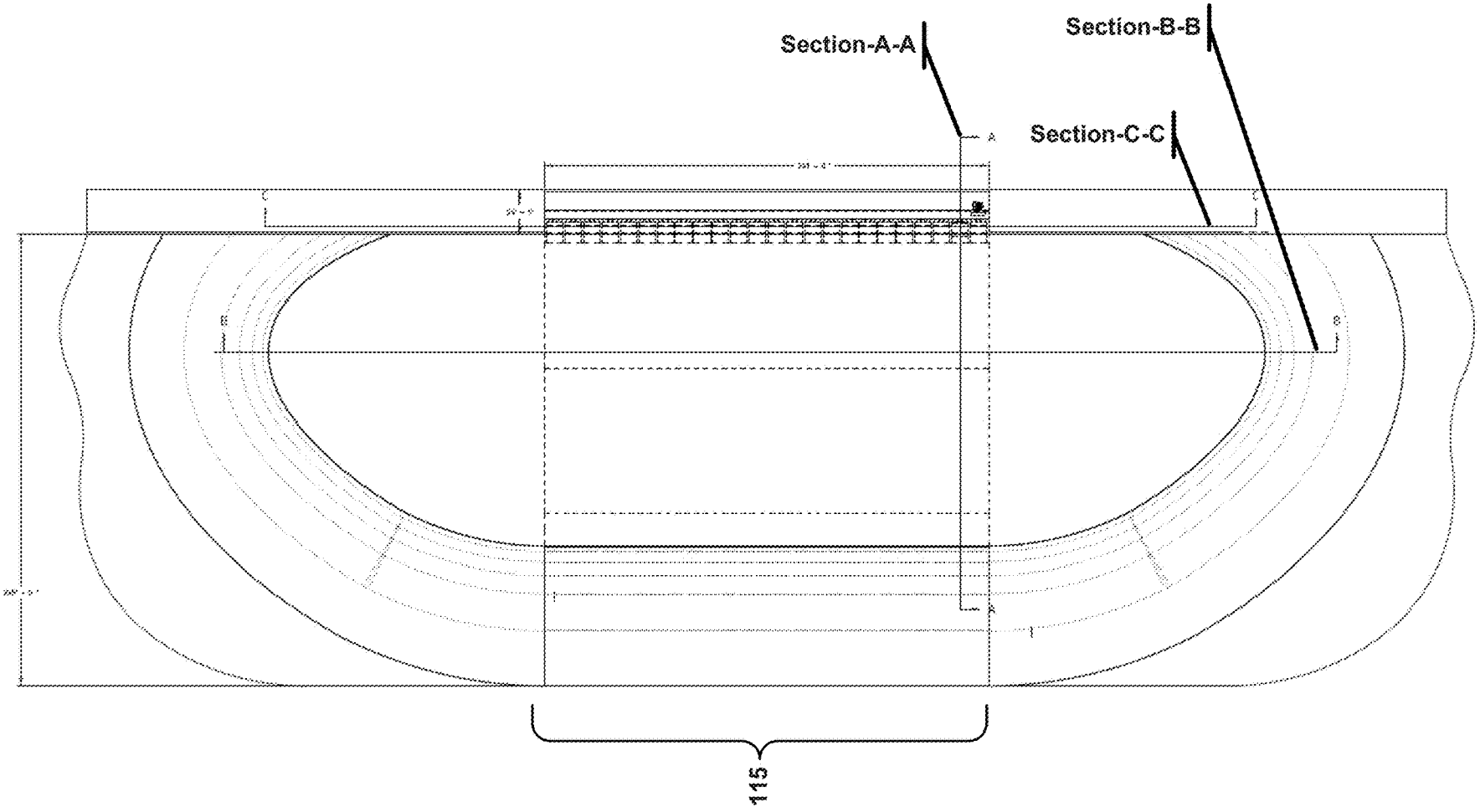
FIG. 2 is a top view of the wave-generating apparatus with several cross-sections indicated.
Figure 4:
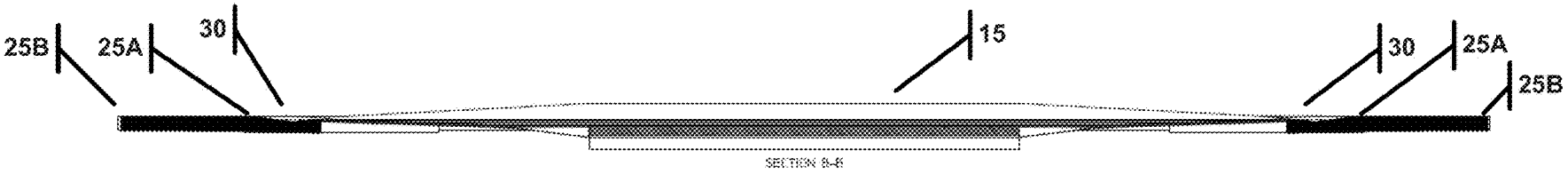
FIG. 4 is the cross-sectional view along line B-B shown in FIG. 2.
Figure 5:
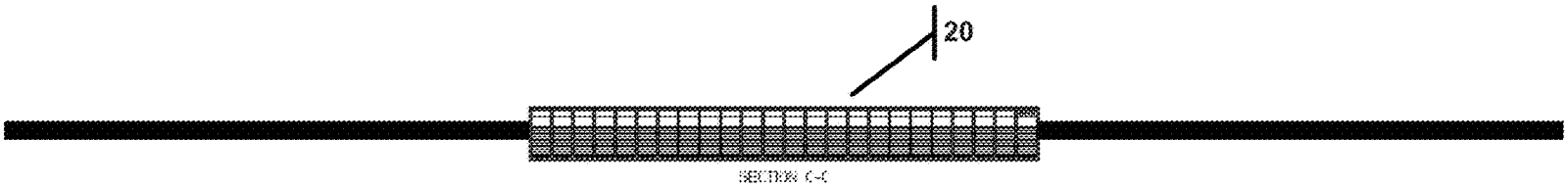
FIG. 5 is the cross-sectional view along line C-C shown in FIG. 2.

FIG. 4 is the cross-sectional view along line B-B shown in FIG. 2. FIG. 5 is the cross-sectional view along line C-C shown in FIG. 2.

FIGS. 6A-6I are several snapshots of a model illustrating the formations of a wave within the wave-generating apparatus and the subsequent reduction in energy of the wave. This model is based on the embodiment illustrated in FIGS. 1-5. These snapshots are taken at a cross-section that is orthogonal to the travel direction of the wave. This is the same perspective as that of FIG. 3A discussed above.

Figure 6A:
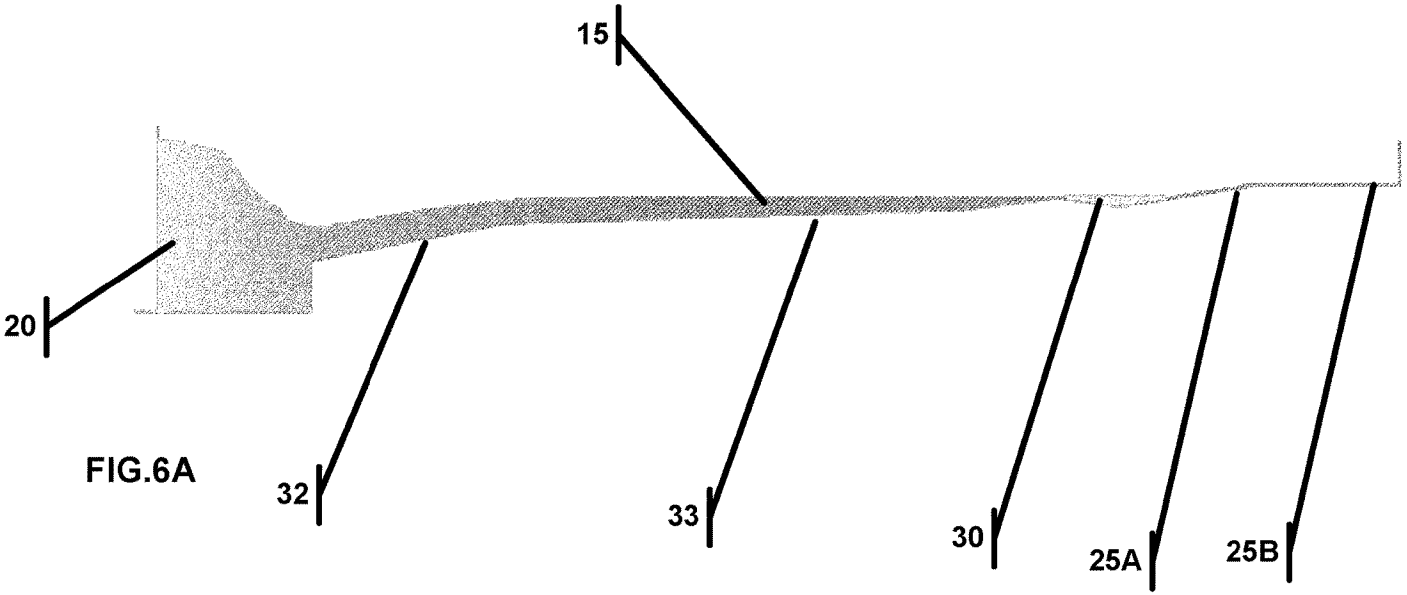
FIG. 6A is a snapshot of a model illustrating the formations of a wave within the wave-generating apparatus, wherein the snapshot is a cross-sectional view that is orthogonal to the travel direction of the wave.
Figure 6B:
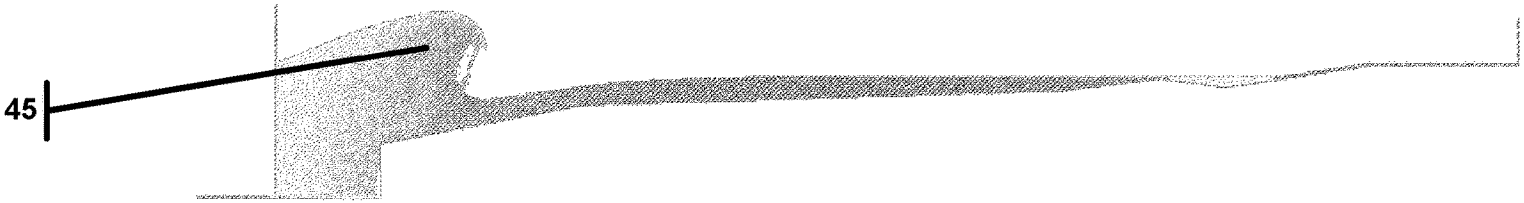
FIG. 6B is a snapshot of the model taken moments after the snapshot depicted in FIG. 6A, wherein the wave has begun to curl.
Figure 6C:
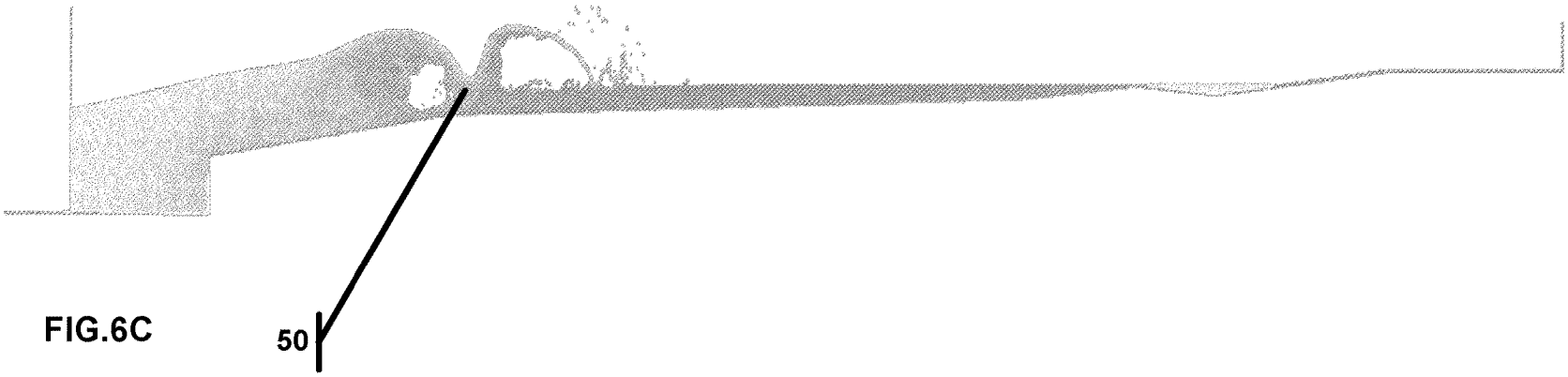
FIG. 6C is a snapshot of the model taken moments after the snapshot depicted in FIG. 6B, wherein the wave has broken and created turbulent whitewater.

FIG. 6A is the first snapshot showing the initial creation of the wave by the wave generator 20. Also shown in in FIG. 6A are the wave pool 15, the wave pool bottom (32, 33), the trough 30, the shore 25A and the beach edge 25B. For simplicity, these reference numerals are not repeated in FIGS. 6B-6I. FIG. 6B is a snapshot taken moments after the snap-shot depicted in FIG. 6A, wherein the wave 45 has been created and has begun to curl. Moments later (shown in FIG. 6C), the wave has broken and created a wave that is curling and breaking 50.

Figure 6D:
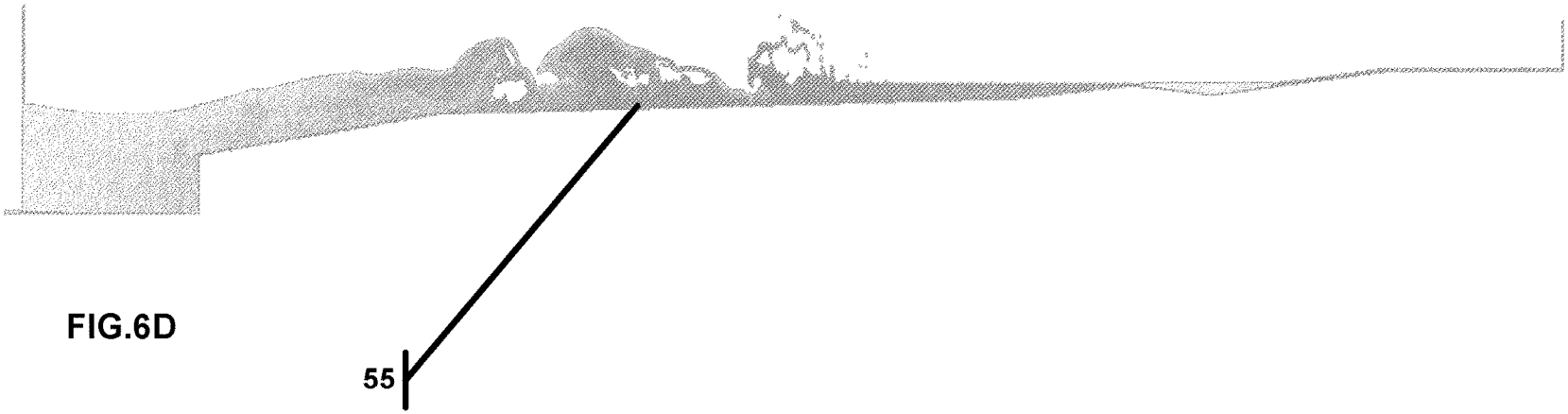
FIG. 6D is a snapshot of the model taken moments after the snapshot depicted in FIG. 6C, wherein the whitewater is turbulently traveling towards the beach end of the wave generating apparatus.
Figure 6E:
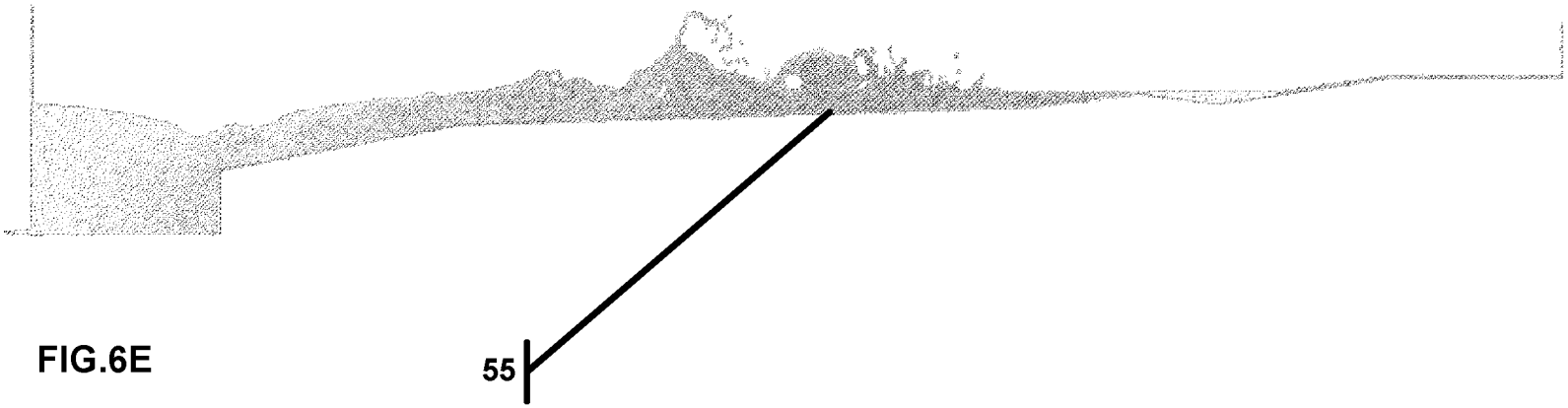
FIG. 6E is a snapshot of the model taken moments after the snapshot depicted in FIG. 6D, wherein the whitewater is turbulently traveling towards the beach end of the wave generating apparatus.
Figure 6F:
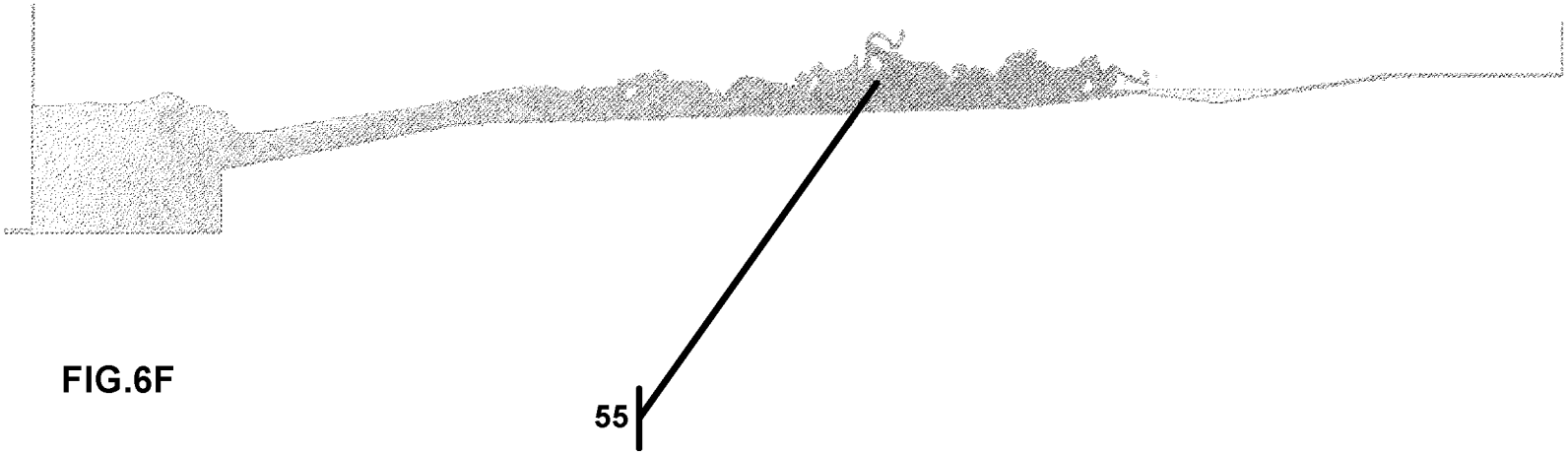
FIG. 6F is a snapshot of the model taken moments after the snapshot depicted in FIG. 6E, wherein the whitewater is turbulently traveling towards the beach end of the wave-generating apparatus and is about to reach the wave-damping trough.
Figure 6G:
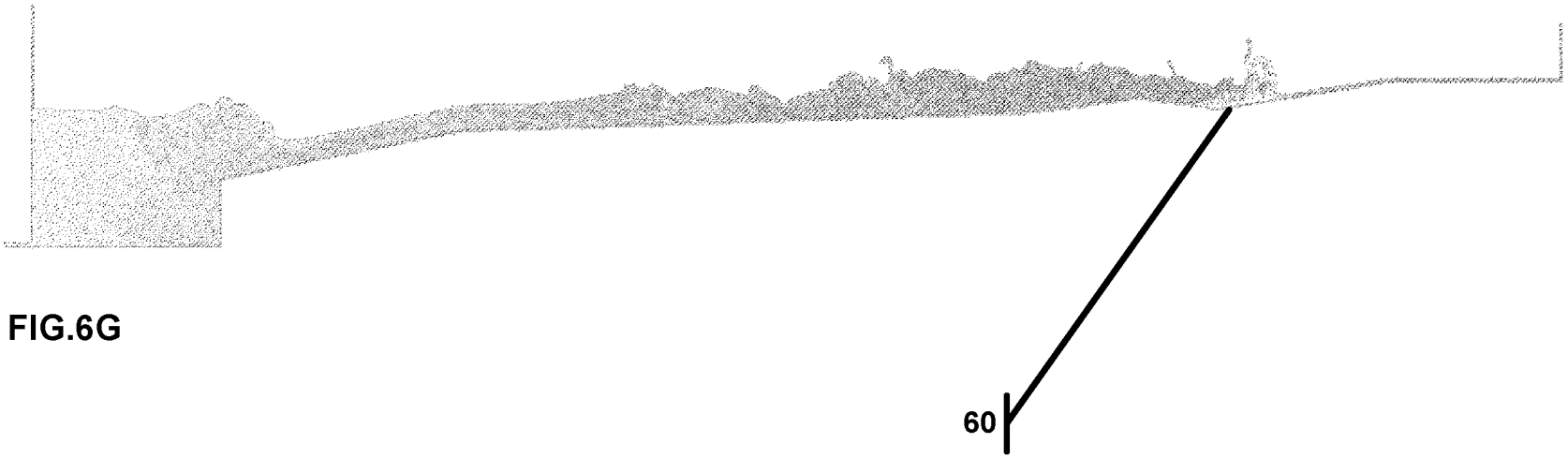
FIG. 6G is a snapshot of the model taken moments after the snapshot depicted in FIG. 6F, wherein the whitewater has reached and slammed into the water residing in the wave-damping trough.
Figure 6H:
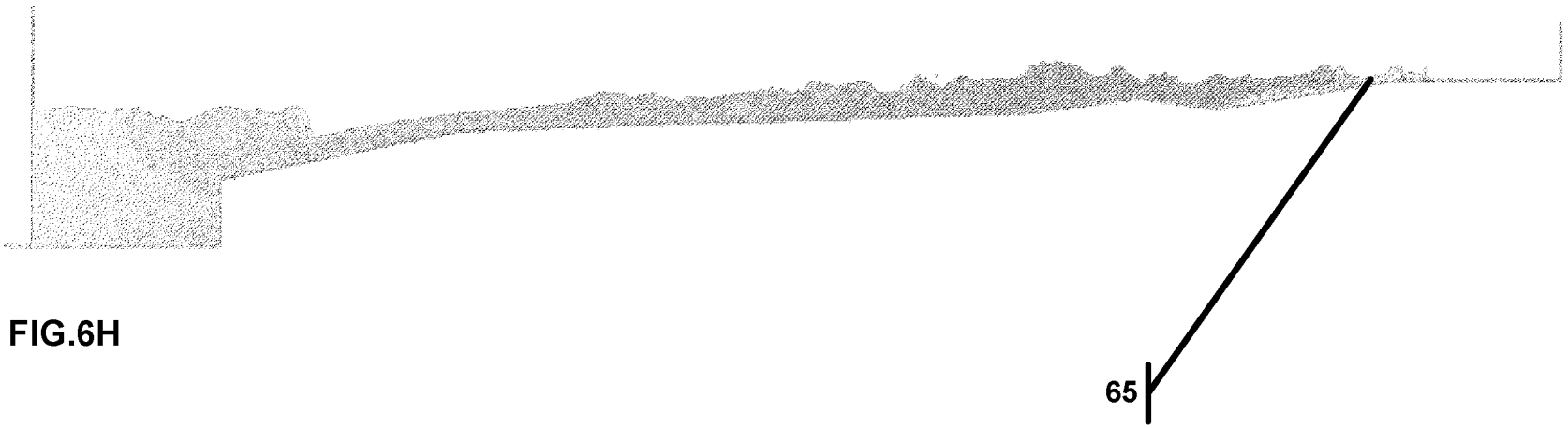
FIG. 6H is a snapshot of the model taken moments after the snapshot depicted in FIG. 6G, wherein the whitewater has mixed with the water in the wave-damping trough, and the mixture has been significantly dampened as the mixture continues its travel towards the beach end of the wave-generating apparatus.
Figure 6I:
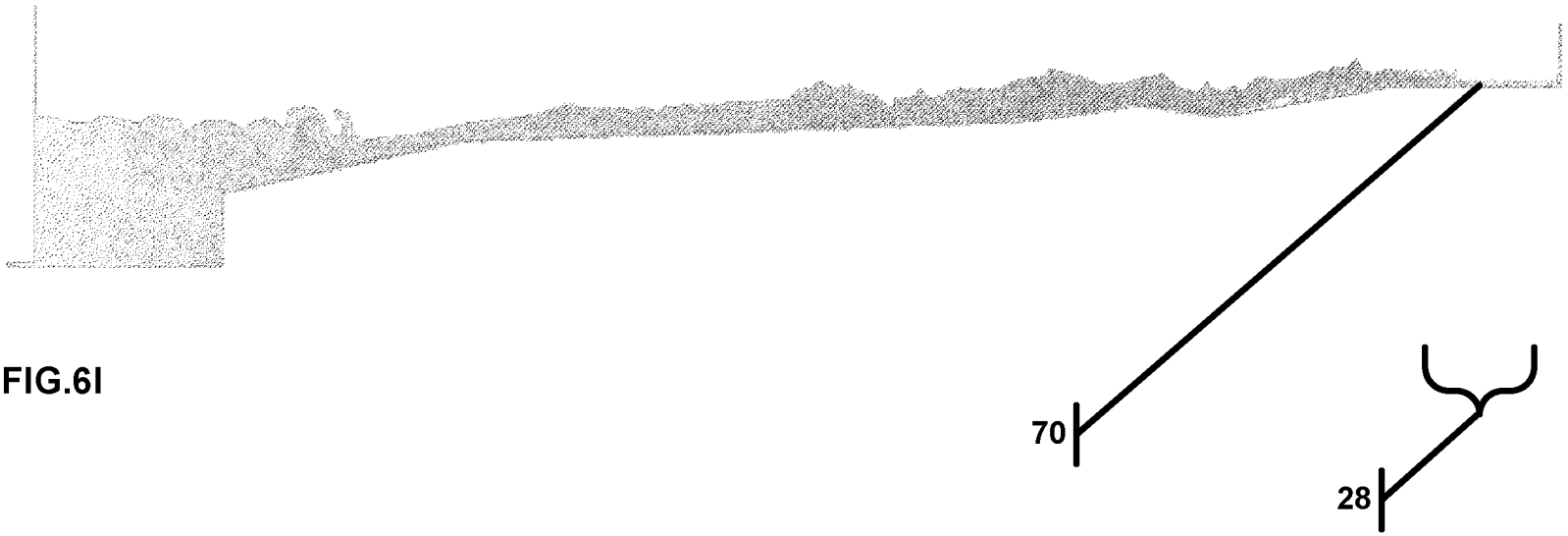
FIG. 6I is a snapshot of the model taken moments after the snapshot depicted in FIG. 6H, wherein the whitewater has completely mixed with the water in the wave-damping trough, and the mixture has been substantially completely dampened as the mixture reaches the edge of the beach end of the-generating apparatus.

FIGS. 6D, 6E and 6F illustrate the resultant whitewater 55 that is approaching the wave-damping trough 30. At FIG. 6G, the whitewater has reach and slammed into the water residing in the wave-damping trough 30. Here, the wave surge from the whitewater has first begun to damp out as it mixes 60 with the water in the damping trough 30. In FIG. 6H, yet more of the whitewater surge has mixed with the water in the wave-damping trough 30 and the mixture 65 has been significantly dampened. Finally, FIG. 6I illustrates that the whitewater has completely mixed with the water in the wave-damping trough 30, and the mixture 70 has been substantially completely dampened as the mixture 70 reaches the shore and the beach edge and flows over the portion of the shore that is above the static water level 27.

Figure 7A:
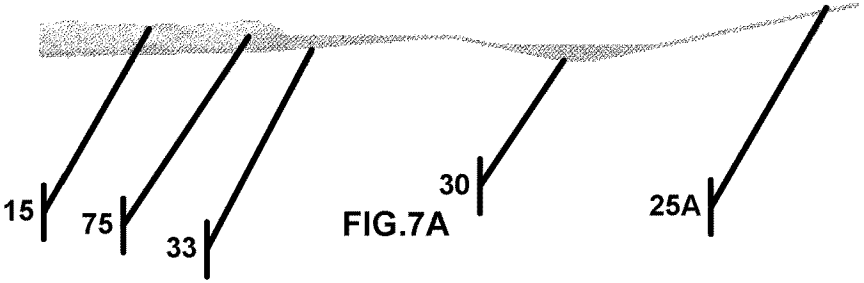
FIG. 7A is a snapshot of the model after the wave-generating apparatus has created a wave, and the wave has propagated across the wave pool forming whitewater, wherein the snapshot is a cross-sectional view that is orthogonal to the travel direction of the wave.
Figure 7B:
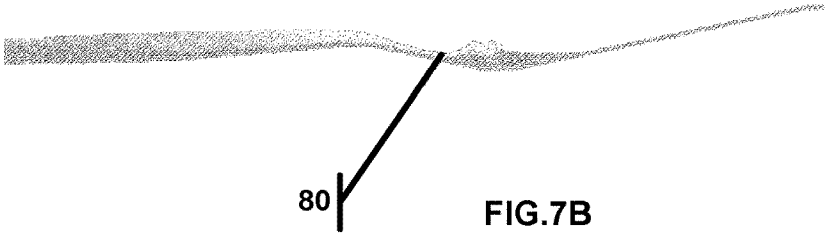
FIG. 7B is a snapshot of the model taken moments after the snapshot depicted in FIG. 7A, wherein the whitewater has reached and slammed into the water residing in the wave-damping trough.
Figure 7C:
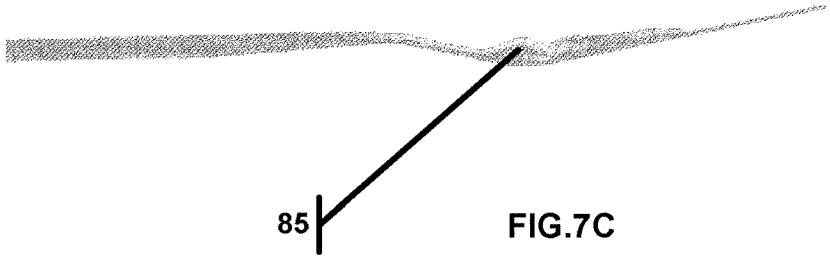
FIG. 7C is a snapshot of the model taken moments after the snapshot depicted in FIG. 7B, wherein the whitewater has mixed with the water in the wave-damping trough, and the mixture has been significantly dampened as the mixture continues its travel towards the beach end of the wave-generating apparatus.

FIGS. 7A-C are several snapshots of a model illustrating the formations of a wave within the wave-generating apparatus and the subsequent reduction of backwash into the wave pool. Backwash from a previous wave can reduce the quality of subsequent waves. To avoid these negative effects, the current practice is to wait until the wave pool is placid (or close to placid) before actuating the wave-generating apparatus to product another wave. This delay reduces the efficiency of the wave pool by limiting the number of rideable waves produced within a given time. Reducing or eliminating backwash allows the wave-generating apparatus to operate more efficiently, resulting in higher profitability for the operators of the apparatus. FIG. 7A is a first snapshot of the model after the wave-generating apparatus has created a wave and the wave has propagated across the wave pool forming whitewater 75, wherein the snapshot is a cross-sectional view that is orthogonal to the travel direction of the wave. Also shown in in FIG. 7A are the wave pool 15, the wave pool bottom (33), the trough 30, and the shore 25A. For simplicity, these reference numerals are not repeated in FIGS. 7B-7F. FIG. 7B is a snapshot taken moments after the snap-shot depicted in FIG. 7A, wherein the whitewater 80 has reached and slammed into the water residing in the wave-damping trough. Moments later (shown in FIG. 7C), the whitewater has mixed with the water in the wave-damping trough, and the mixture 85 has been significantly dampened as the mixture continues its travel towards the beach end of the wave-generating apparatus.

Figure 7D:
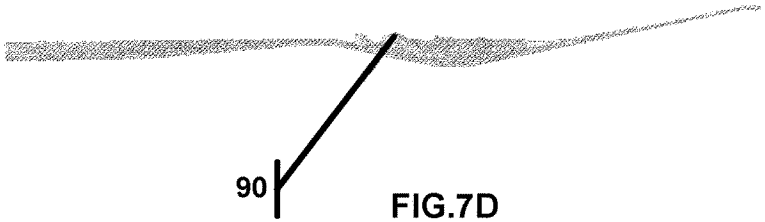
FIG. 7D is a snapshot of the model taken moments after the snapshot depicted in FIG. 7C, wherein the mixture of whitewater and the water in the wave-damping trough have formed back wash, and the backwash is propagating in a direction opposite to the original wave.
Figure 7E:
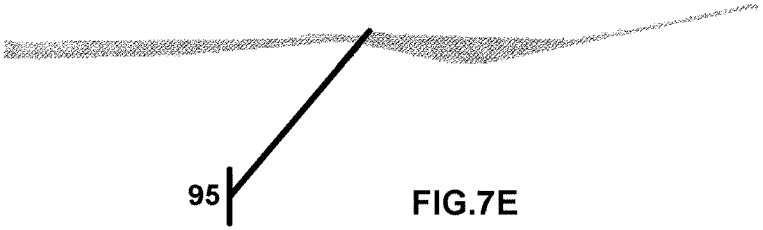
FIG. 7E is a snapshot of the model taken moments after the snapshot depicted in FIG. 7D, wherein the propagation of the backwash is significantly dampened by the wave-damping trough.
Figure 7F:
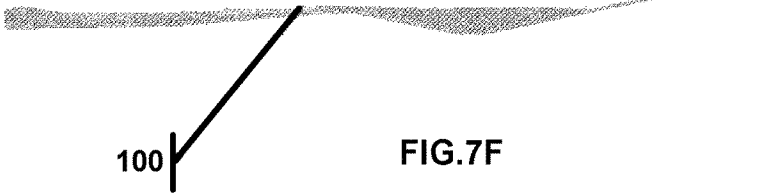
FIG. 7F is a snapshot of the model taken moments after the snapshot depicted in FIG. 7E, wherein a relatively minor portion of the backwash has traveled outside of the wave-damping trough.

FIGS. 7D, 7E, and 7F illustrate the damping of the backwash formed. FIG. 7D is a snapshot of the model taken moments after the snapshot depicted in FIG. 7C, wherein the mixture 90 of whitewater and the water in the wave-damping trough have formed back wash and the backwash is propagating in a direction opposite to the original wave. Moments later (shown in FIG. 7E) the propagation of the backwash 95 is significantly dampened by the wave-damping trough, such that at FIG. 7F a relatively minor portion of the backwash has traveled outside of the wave-damping trough.

The wave peak created by the model was approximately six feet above the static water level, and, for such a wave, the model show that more than 50% of the energy from the wave surge is dissipated across the trough 30. Reducing the wave trough width in half to 12 feet, or approximately twice the size of the maximum wave height, while maintaining a one-foot depth, resulted in 25% energy dissipation. Because the size of the apparatus can affect maintenance and constructions costs, it is important to size the beach edge appropriately to optimize expenses. It therefore appears that an optimal relationship is a wave trough that is approximately four times as wide as the produced wave height.

The modeling found that a trough width that is twice the width of the shore, as measured at the shore terminal edge 26, is effective. To reduce the overall footprint of the apparatus, it was found that 50% of the energy can be dissipated if the width is only 50% larger than the trough width. If the energy maintained by the wave surge continues to propel water, a berm or upslope may be necessary on the outer edge of the apparatus to retain the water therein.

Figure 8:
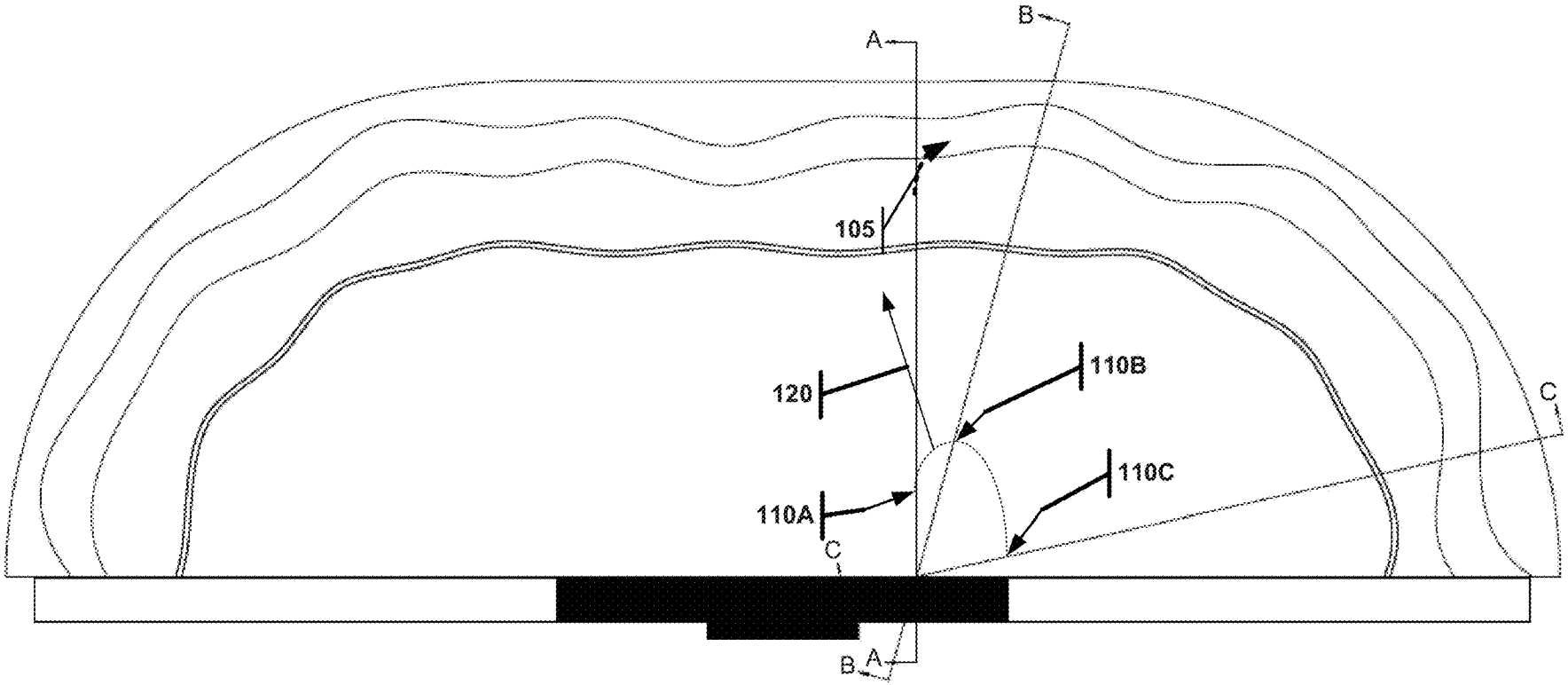
FIG. 8 is a top view of another embodiment of wave-generating apparatus with three cross-sectional wave bottom profiles indicated as lines A-A, B-B and C-C.

FIG. 8 illustrates a floor profile that varies. Specifically, the floor profile varies depending on the path taken by the wave front. Because of this variation, the wave can more efficiently break and dissipate laterally from the wave front. FIG. 8 illustrates three lines A-A, B-B and C-C that are shown in cross-section in FIGS. 8A-A, 8B-B and 8C-C, respectively. The various portions of the floor profile are shown, i.e., the first portion of upwardly-inclined wave pool bottom 32, the second portion of upwardly-inclined wave pool bottom 33, the third portion of upwardly-inclined wave pool bottom 33A, the width of wave-damping trough 34, the shore 25A and the beach edge of pool 25B.

The variance between the various widths of these portions is shown by the lines dashed lines between FIGS. 8A-A, 8B-B and 8C-C. As with the widths, the slopes of the pool bottom also vary. For example, the wave-damping trough may have several regions that have varying slopes. The slope of the shore 25A and the upper inclined portion slope of the trough 34 ($M_{T1}$) of a first region (i.e., FIG. 8A-A) is very steep as compared to the slope ($M_{T2}$) of a second region (i.e., FIG. 8B-B). The trough widths also vary, with the trough width 34 ($T_{W1}$) of the first region (FIG. 8A-A) being narrower than trough width 34 ($T_{W2}$) of the second region (FIG. 8B-B). This variation assists in wave-damping by promoting the wave action to dissipate not only in the same direction as the wave propagation, but also at angles that are lateral to the direction of propagation. Specifically, a wave that breaks in the pool near the cross-section represented by FIG. 8A-A would dissipate some of its wave energy laterally along the wave-damping trough 30 toward the pool area near the cross-section represented by FIG. 8B-B. The reason is that there is less resistance to move up towards the shore 25A that has a shallower slope. This lateral movement within the wave-damping trough is very effective at dissipating wave energy because it exposes the wave front to more water residing in the wave-damping trough. This movement of whitewater lateral (or somewhat lateral) to the original wave propagation direction is shown by arrow 105 in FIG. 8.

Further, the wave forming region of the pool, which consists of the first portion of upwardly-inclined wave pool bottom 32 (see e.g. FIGS. 6A and 6B), can also be varied with different width and slopes. For example, the first portion of upwardly-inclined wave pool bottom 32 in FIG. 8A-A is the steepest ($M_{UT1}$), followed by FIGS. 8C-C ($M_{UT3}$) and then 8B-B. Thus, in the pool near the cross-section represented by FIG. 8A-A, the wave would break at about position 110A, while for the cross-section represented by FIG. 8B-B, it would break at about 110B. This wave breaking position is shown in the top view of FIG. 8. The wave riding region consists of the second portion of the upwardly-inclined wave pool bottom 33, and it varies between the different profiles as well. The first profile of FIG. 8A-A may have a second portion of the upwardly-inclined wave pool bottom 33 with a slope of $M_{UT2}$ while the second profile has a slope of $M_{UT4}$.

Designing the pool bottom to have different areas where wave breaking is promoted, allows for more optimal wave riding. Specifically, if the pool bottom is uniform along the propagation of the wave, then a wave formed by a series of wave generators 20 will break along a line parallel to the front of the wave generators 20. For example, FIG. 2 has a region 115 where the floor bottom is uniform. The waves will break at about the end of the first portion of the upwardly-inclined wave pool bottom 32 (see FIG. 3A), and the users can ride the wave in the second portion of the upwardly-inclined wave pool bottom 33, with a wave propagation that is substantially perpendicular to the front of the wave generators 20 (i.e., parallel to the direction of arrow 12 in FIG. 1).

But by having a variable pool bottom with a variable first portion of upwardly-inclined wave pool bottom profile, as in FIG. 8, the wave propagates in a direction that is not substantially perpendicular to the front of the wave generators 20. Connecting the wave break positions 110A, 110B and 110C shows that a rider might ride the wave propagation in the direction of arrow 120. This direction may allow for a long ride, as compared to the uniform floor bottom design.

Figure 9A:
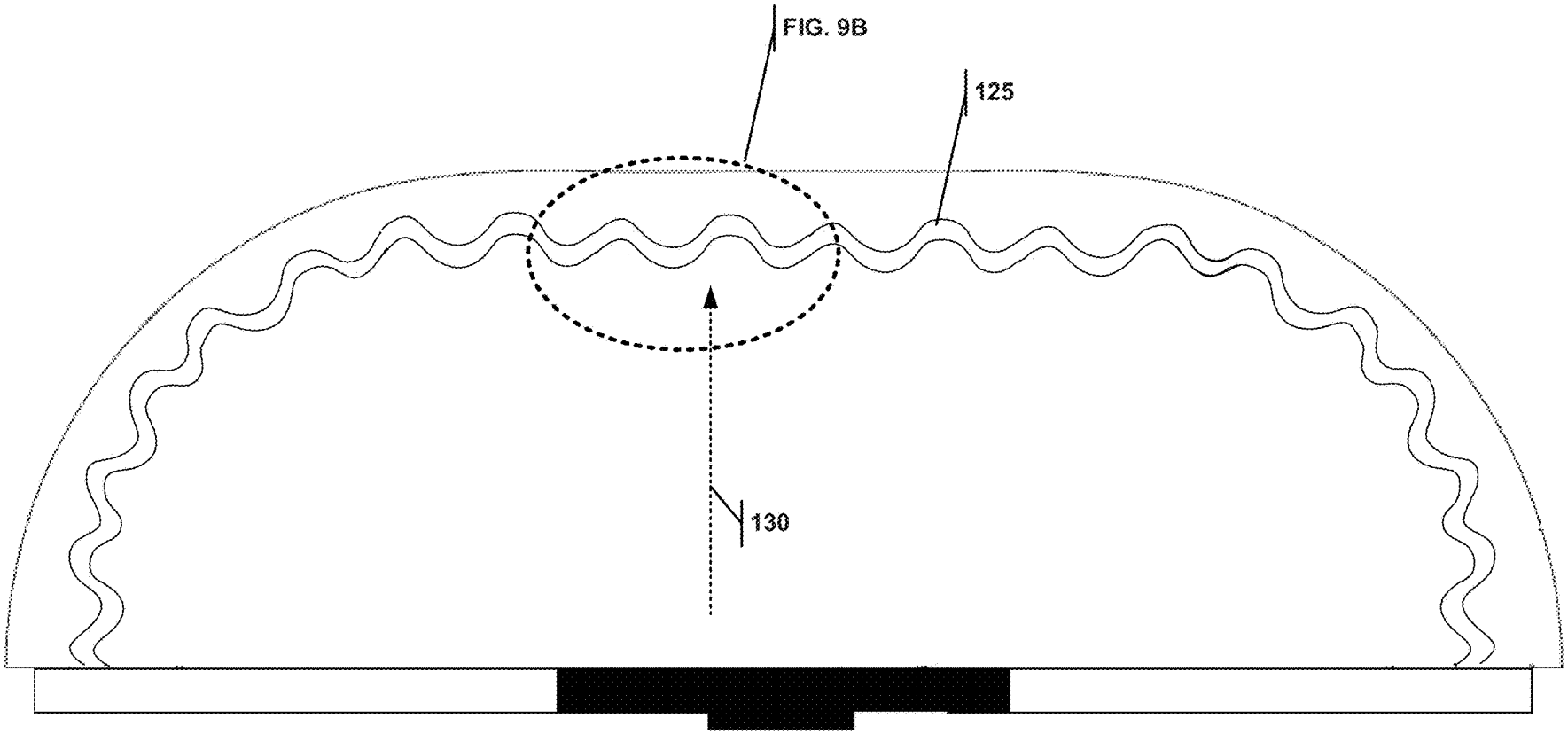
FIG. 9A is a top view of another embodiment of wave-generating apparatus, with a wave-damping trough that undulates alternately towards and away from the direction of wave propagation.

FIG. 9A illustrates yet another embodiment of the wave-generating apparatus with a wave-damping trough. Here the trough 125 undulates alternately towards and away from the direction of wave propagation 130. The undulation promotes superior wave energy dissipation by allowing the water to spill laterally. This movement of whitewater lateral (or somewhat lateral) to the original wave propagation direction is shown by arrows 135 in FIG. 9C. This lateral movement, within the undulating damping trough 125, is very effective at dissipating wave energy because it exposes the wave front to more water residing in the wave-damping trough.

Figure 9B:
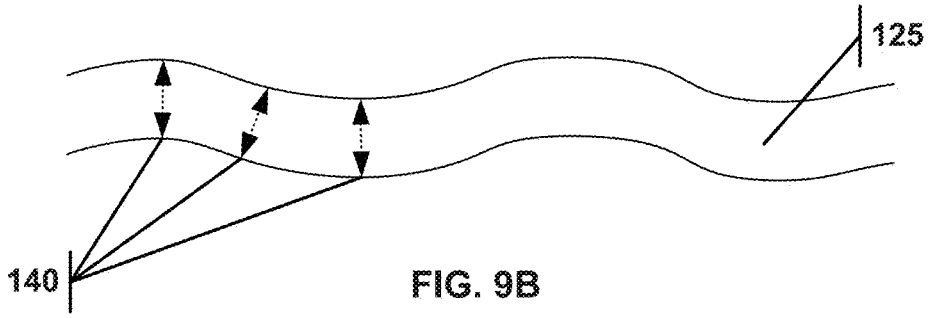
FIG. 9B is an enlarged view of the undulating wave-damping trough of FIG. 9B.
Figure 9C:
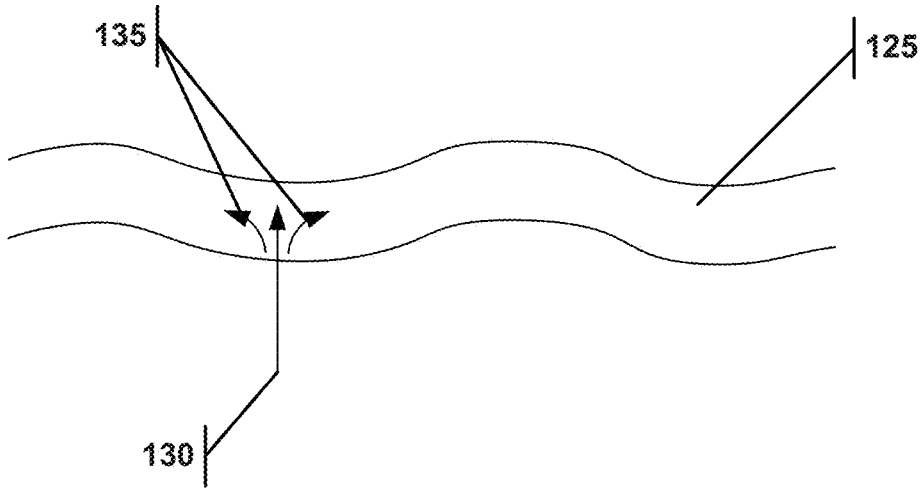
FIG. 9C is another enlarged view of the undulating wave-damping trough of FIG. 9A.

The width of the wave-damping trough may vary, as shown in FIG. 8, and may have different upper inclined portion slopes, as shown in FIGS. 8A-A, 8B-B and 8C-C. Alternatively, as shown in FIGS. 9A-9C, the width of the trough can remain constant, as can the upper inclined portion slope. A constant width means that although the trough 125 undulates relative to the wave propagation direction 130, the width as measured from the tangent of the trough inner edge to a tangent on the trough outer edge is substantially constant, as shown in FIG. 9B, where the widths 140 are substantially equal to each other. Along, these widths, the upper inclined portion slope is substantially constant.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

The invention claimed is:

1. A wave-generating apparatus, comprising:

a deep edge;

a beach edge having a shore and a shore terminal edge;

a wave generator adjacent to the deep edge;

a wave pool with a pool bottom, wherein the pool bottom comprises two portions, a first pool bottom portion having a first angle of inclination relative to horizontal, and a second pool bottom portion having a second angle relative to horizontal, wherein the first angle is greater than the second angle; and a wave-damping trough adjacent to the shore and adapted to retain water, the trough comprising:

a mound with a mound height forming a first edge of the wave-damping trough that separates the water in the wave-damping trough from the water in the wave pool;

a trough bottom; and a second edge of the wave-damping trough extending from the trough bottom and sloped upward to meet the shore and the beach edge of the apparatus;

wherein when the wave generator is not actuated, the wave pool retains water defining a static water level that is below the mound height of the wave-damping trough, and the wave-damping pool retains a static body of water below the mound height separated from the water in the wave pool; and wherein when the wave generator is actuated, a wave forms at the deep edge, breaks over the junction of the first pool bottom portion and the second pool bottom portion, travels over the second pool bottom portion, then travels over the mound of the wave-damping trough toward the shore terminal edge, and wherein the wave energy is dampened by the static body of water retained in the wave-damping trough, such that the wave white water is dampened as the wave travels from the first edge of the wave-damping trough towards the second edge of the wave-damping trough and the shore, and the wave backwash is dampened as it travels from the second edge of the wave-damping trough towards the first edge of the wave-damping trough.

2. The apparatus of claim 1, wherein the wave energy is dampened by greater than 50% when the wave has reached the shore terminal edge.

3. The apparatus of claim 1, wherein the second edge of the wave-damping trough comprises:

a first region with a first trough width $T_{W1}$ and a first bottom upward trough slope $M_{T1}$;

a second region with a second trough width $T_{W2}$ and a second bottom upward trough slope $M_{T2}$, wherein $T_{W1} \neq T_{W2}$ and $M_{T1} \neq M_{T2}$.

4. The apparatus of claim 1, wherein the first pool bottom portion is closer to the wave generator than the second pool bottom portion.

5. The apparatus of claim 1, further comprising:

a first cross-sectional profile with a first upwardly inclined region adjacent to the wave generator with a first upwardly inclined region slope $M_{UI1}$ and a second upwardly inclined region adjacent to the first upwardly inclined region with a second upwardly inclined region slope $M_{UI2}$; and a second cross-sectional profile with a first upwardly inclined region adjacent to the wave generator with a first upwardly inclined region slope $M_{UI3}$ and a second upwardly inclined region adjacent to the first upwardly inclined region with a second upwardly inclined region slope $M_{UI4}$; and wherein $M_{UI1} \neq M_{UI3}$ and $M_{UI2} \neq M_{UI4}$.

6. The apparatus of claim 1, wherein the wave generator is comprised of a plurality of wave generators.

7. The apparatus of claim 1, wherein:

the mound of the wave-damping trough has a maximum height point and a plane parallel to horizontal and intersecting the maximum height point, wherein the trough has a trough bottom and a trough width defined by where the trough bottom intersects the plane;

wherein the shore has an upwardly-inclined shore bottom and a shore width defined on one edge where the shore bottom intersects the plane and on an opposite edge where the shore bottom is substantially horizontal; and wherein the shore width is at least 50% longer than the trough width.

8. The apparatus of claim 1, wherein:

the mound of the wave-damping trough has a maximum height point and a plane parallel to horizontal and intersecting the maximum height point, wherein the trough has a trough bottom and a trough width defined by where the trough bottom intersects the plane;

wherein the shore has an upwardly-inclined shore bottom and a shore width defined on one edge where the shore bottom intersects the plane and on an opposite edge where the shore bottom is substantially horizonal; and wherein the shore width is at least twice the trough width.

9. The apparatus of claim 1, wherein the trough further comprises a pump that creates a current in a direction substantially orthogonal to the direction of the wave propagation.

10. The apparatus of claim 1, wherein the wave-damping trough and the pool bottom are separated by a mound, and the height of the mound is controlled by a mound elevator.

11. The apparatus of claim 10, wherein the wave-damping trough further comprises a sand filter and a pump, and wherein when the mound elevator is actuated, it lowers the mound below the static water level, allowing the pump to pull water from the wave pool into the trough and through the sand filter.

12. The apparatus of claim 10, wherein the mound elevator is selected from a group consisting of: a ram, a piston, a cam or a bladder.

13. The apparatus of claim 1, wherein the wave-damping trough further comprises a sand filter and a pump.

14. The apparatus of claim 13, wherein the pump can be actuated to drain water from the wave-damping trough into the wave pool.

* * * * *